US010508504B2

(12) United States Patent
Hardin, Jr. et al.

(10) Patent No.: US 10,508,504 B2
(45) Date of Patent: Dec. 17, 2019

(54) REDUNDANT, ADAPTABLE SLIP RING

(71) Applicant: Halliburton Energy Services, Inc., Houston, TX (US)

(72) Inventors: John R. Hardin, Jr., Spring, TX (US); Christopher A. Golla, Kingwood, TX (US); Jonathan P. Zacharko, Edmonton (CA); David Yan Lap Wong, Edmonton (CA); Daniel M. Winslow, Spring, TX (US); Richard Thomas Hay, Spring, TX (US); Kennedy Kirkhope, Sherwood Park (CA); Clint P. Lozinsky, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 795 days.

(21) Appl. No.: 15/036,379

(22) PCT Filed: Dec. 12, 2013

(86) PCT No.: PCT/US2013/074534

§ 371 (c)(1),
(2) Date: May 12, 2016

(87) PCT Pub. No.: WO2015/088527

PCT Pub. Date: Jun. 18, 2015

(65) Prior Publication Data

US 2016/0290059 A1 Oct. 6, 2016

(51) Int. Cl.

| | |
|---|---|
| ***E21B 17/00*** | (2006.01) |
| ***E21B 47/00*** | (2012.01) |
| ***E21B 47/12*** | (2012.01) |

(52) U.S. Cl.

CPC ..... *E21B 17/003* (2013.01); *E21B 47/00* (2013.01); *E21B 47/122* (2013.01)

(58) Field of Classification Search

CPC ..... E21B 17/003; E21B 47/122; E21B 47/00; E21B 47/12

See application file for complete search history.

(56) References Cited

U.S. PATENT DOCUMENTS 6,899,174 B2 5/2005 Maxwell et al.
7,312,720 B2 12/2007 Dodge et al.

(Continued)

FOREIGN PATENT DOCUMENTS

EP 1643602 A1 4/2006

OTHER PUBLICATIONS

Ethernet Powerlink, http://www.ethemet-powerlink.org/en/powerlink/technology/, 1 page.

(Continued)

*Primary Examiner* — Brad Harcourt
(74) *Attorney, Agent, or Firm* — Alan Bryson; Baker Botts L.L.P.

(57) ABSTRACT

An example slip-ring interface may include a first section and a second section rotationally independent from the first section. At least one conductor path between the first section and the second section may be selectively associated with and dedicated to the transmission of signals with a first signal type. At least one conductor path between the first section and the second section may be selectively associated with and dedicated to the transmission of signals with a second signal type. If error conditions occur, the signal types associated with one or more of the conductor paths may be changed so that signals of both the first and second signal types are transmitted across the interface.

18 Claims, 4 Drawing Sheets

(56) References Cited

U.S. PATENT DOCUMENTS

| | | | | |
|---|---|---|---|---|
| 7,320,363 | B2 | 1/2008 | Sand et al. | |
| 7,708,086 | B2 | 5/2010 | Witte | |
| 7,819,666 | B2 | 10/2010 | Sihler et al. | |
| 8,070,446 | B2 | 12/2011 | Potter et al. | |
| 8,157,002 | B2 | 4/2012 | Clarkson et al. | |
| 2003/0180145 | A1* | 9/2003 | Goldberg | F01D 7/00 416/1 |
| 2003/0213620 | A1 | 11/2003 | Krueger | |
| 2006/0021797 | A1 | 2/2006 | Krueger | |
| 2006/0124354 | A1 | 6/2006 | Witte | |
| 2008/0035376 | A1 | 2/2008 | Freyer | |
| 2008/0230273 | A1 | 9/2008 | Brooks | |
| 2010/0175923 | A1 | 7/2010 | Allan | |
| 2012/0048533 | A1 | 3/2012 | Barker | |
| 2012/0176138 | A1 | 7/2012 | Prammer | |
| 2012/0218061 | A1 | 8/2012 | West et al. | |
| 2012/0251317 | A1 | 10/2012 | Reitmaier | |

OTHER PUBLICATIONS

International Search Report and Written Opinion issued in related PCT Application No. PCT/US2013/074534 dated Sep. 12, 2014, 12 pages.

International Preliminary Report on Patentability issued in related Application No. PCT/US2013/074534, dated Jun. 12, 2016 (22 pages).

* cited by examiner

REDUNDANT, ADAPTABLE SLIP RING

CROSS-REFERENCE TO RELATED APPLICATION

The present application is a U.S. National Stage Application of International Application No. PCT/US2013/074534 filed Dec. 12, 2013, which is incorporated herein by reference in its entirety for all purposes.

BACKGROUND

The present disclosure relates generally to well drilling operations and, more particularly, to a redundant, adaptable slip ring for downhole power and communications.

Hydrocarbons, such as oil and gas, are commonly obtained from subterranean formations that may be located onshore or offshore. The development of subterranean operations and the processes involved in removing hydrocarbons from a subterranean formation are complex. Downhole drilling assemblies and tools may include portions that are rotationally independent, both in terms of direction and speed. These rotationally independent portions, however, typically utilize the same power source and communications channels. Accordingly, power and/or communications must be transmitted across an interface between the rotationally independent portions.

FIGURES

Some specific exemplary embodiments of the disclosure may be understood by referring, in part, to the following description and the accompanying drawings.

Figure 1:
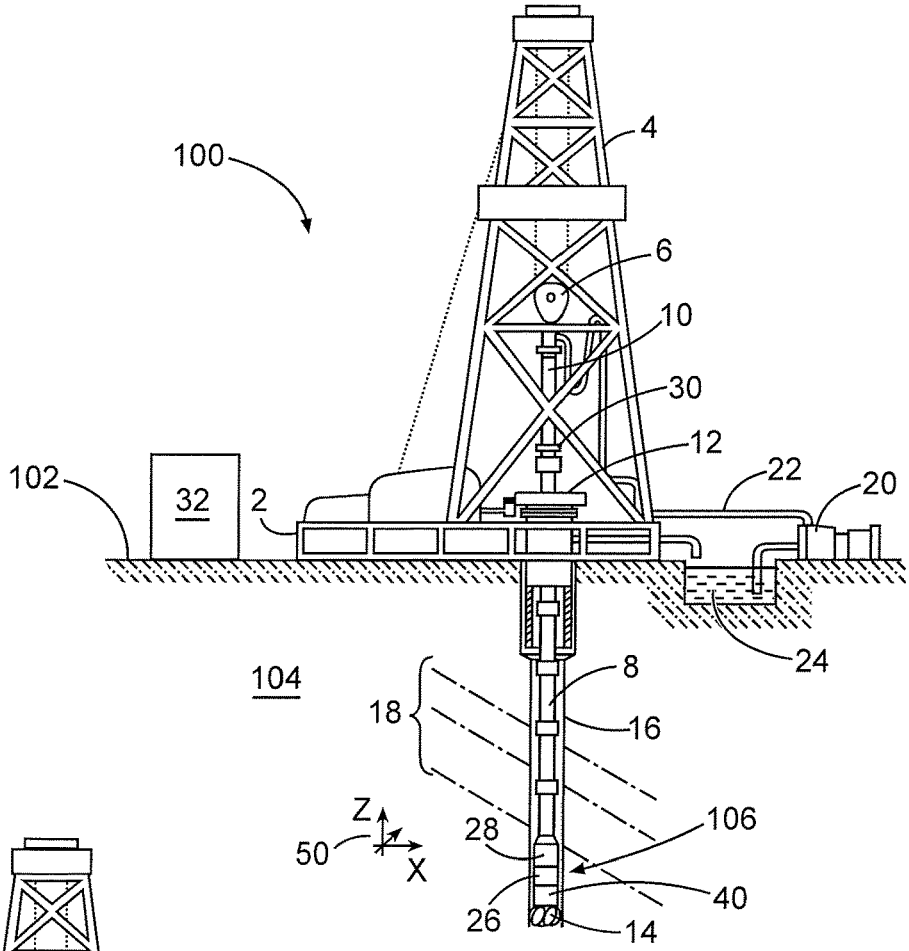
FIG. 1 is a diagram showing an illustrative logging-while-drilling environment, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

FIG. 1 is a diagram of a subterranean drilling system 100, according to aspects of the present disclosure. The drilling system 100 comprises a drilling platform 2 positioned at the surface 102. In the embodiment shown, the surface 102 comprises the top of a formation containing one or more rock strata or layers 18, and the drilling platform 2 may be in contact with the surface 102. In other embodiments, such as in an off-shore drilling operation, the surface 102 may be separated from the drilling platform 2 by a volume of water.

The drilling system 100 comprises a derrick 4 supported by the drilling platform 2 and having a traveling block 6 for raising and lowering a drill string 8. A kelly 10 may support the drill string 8 as it is lowered through a rotary table 12. A drill bit 14 may be coupled to the drill string 8 and driven by a downhole motor and/or rotation of the drill string 8 by the rotary table 12. As bit 14 rotates, it creates a borehole 16 that passes through one or more rock strata or layers 18. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity of the borehole 16.

The drilling system 100 may comprise a bottom hole assembly (BHA) 106 coupled to the drill string 8 near the drill bit 14. The BHA may comprise one or more downhole tools 26 and 40 and a telemetry element 28. In certain embodiments, at least one of the downhole tools 26 and 40 or a portion of at least one of the downhole tools 26 and 40 may be partially or totally rotationally independent from the remainder of the drill string 8 or from an adjacent downhole tool. For example, downhole tool 26 may comprise a LWD/MWD tool with one or more receivers and/or transmitters (e.g., antennas capable of receiving and/or transmitting one or more electromagnetic signals) positioned on a rotationally independent sleeve. Similarly, downhole tool 40 may comprise a steering system with one or more extendable arms on a rotationally independent or non-rotating portion. Other downhole tools and elements with rotationally independent internal or external portions are possible.

In certain embodiments, the downhole tools 26 and 40 may comprise their own power sources (e.g., battery packs) or may receive power from a power source located outside of the tools. For example, the power source may be located in the telemetry sub 28 or within a power source for the entire BHA. In certain embodiments, the telemetry sub 28 may provide at least one of power and communications to the tools 26 and 40. The tools 26 and 40 may communicate with a surface control unit 32 positioned at the surface 102 through the telemetry element 28. As will be described below, power and communications signals may be transmitted across and interface between the rotationally independent portions of the tools 26 and 40.

Figure 2:
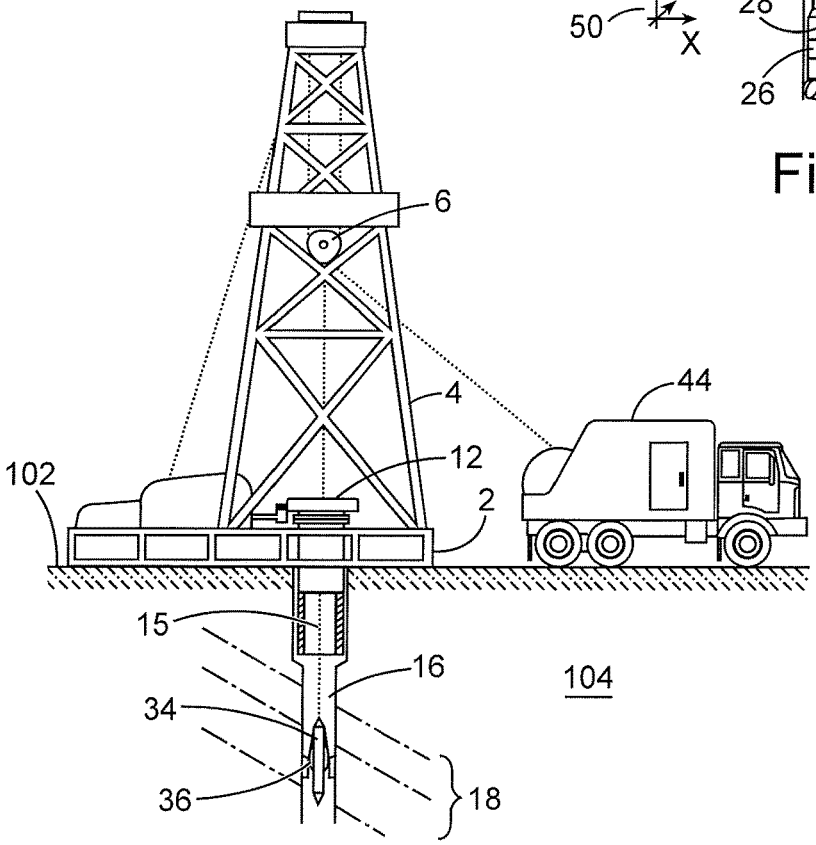
FIG. 2 is a diagram showing an illustrative wireline logging environment, according to aspects of the present disclosure.

At various times during the drilling process, the drill string 8 may be removed from the borehole 16 as shown in FIG. 2. Once the drill string 8 has been removed, measurement/logging operations can be conducted using a wireline tool 34, i.e., an instrument that is suspended into the borehole 16 by a cable 15 having conductors for transporting power to the tool and telemetry from the tool body to the surface 102. Like the drilling system in FIG. 1, the wireline tool 34 may include one or more downhole tools 36 having a rotationally independent portion. In the embodiment shown, the tool 36 may comprise a logging/measurement tool with transmitters and/or receivers located on the rotationally independent portions. Power for the transmitters and/or receivers and/or measurements generated by the transmitters and/or receivers may be transmitted across an interface between a stationary portion of the tool and the rotationally independent portion of the tool 36. Measurements may be transmitted to a logging facility 44 through the cable 15, for example. The logging facility 44 may collect measurements from the logging tool 36, and may include computing facilities (including, e.g., an information handling system) for controlling, processing, storing, and/or visualizing the measurements gathered by the logging tool 36.

Figure 3:
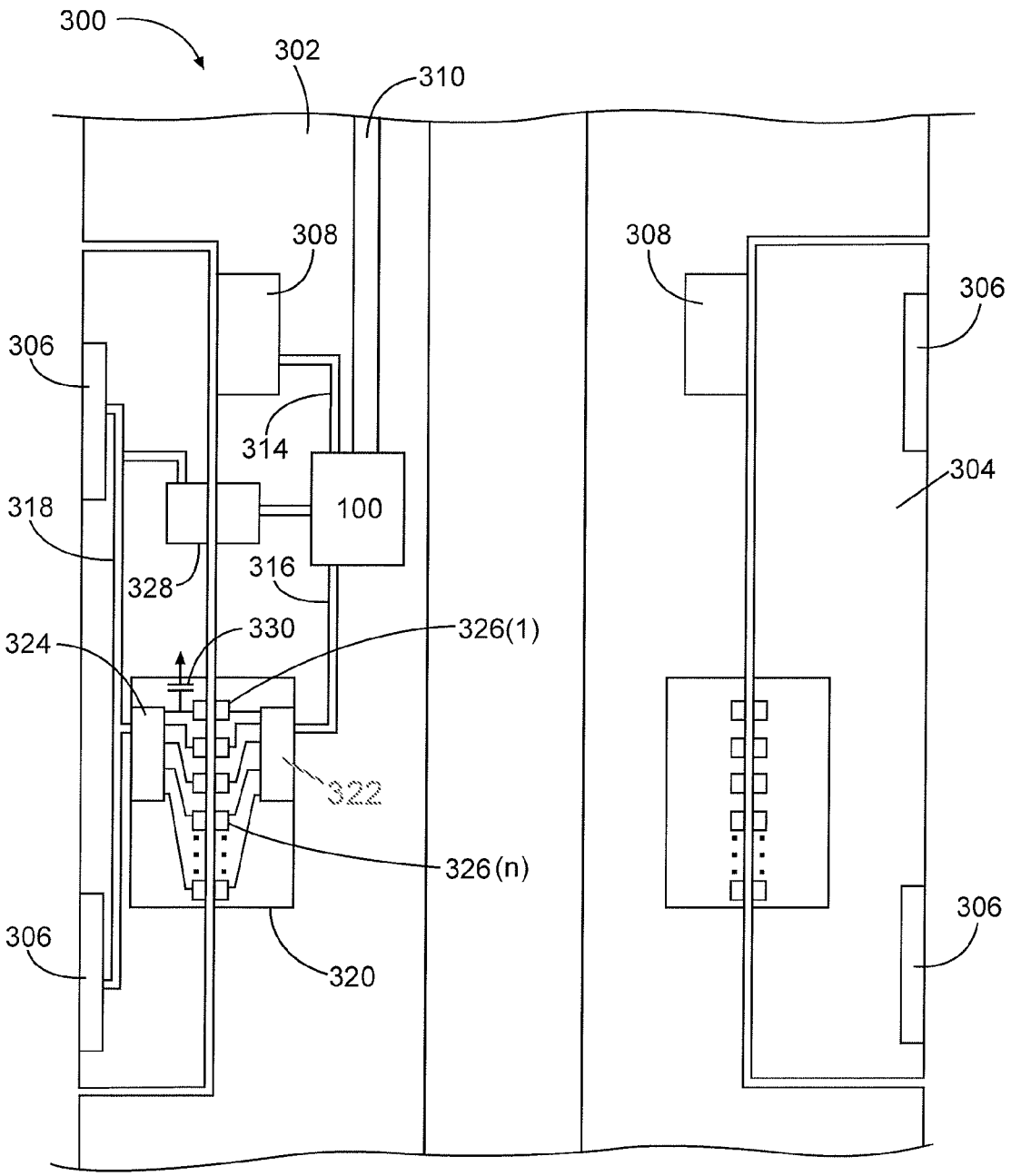
FIG. 3 is a diagram of an example downhole tool, according to aspects of the present disclosure.

FIG. 3 is a diagram illustrating an example downhole tool 300, according to aspects of the present disclosure. In the embodiment shown, the downhole tool 300 comprises a first portion 302 and a second portion 304 that is rotationally independent from the first portion 302. The second portion 304 may comprise an electronic element 306 and may be rotated with respect to the first portion 302 by a motor 308. Power and communications for the tool 300 may be received at the tool 300 through a cable 310. The power and communications may be provided by sources located outside of the tool 300, such as from the surface in a wireline tool configuration or from a telemetry system in a drilling assembly configuration. In other embodiments, power and communications may be provided by sources in the tool 300, such as a power source (not shown) located in either the first portion 302 or second portion 304 of the tool 300.

In certain embodiments, power and communications may be received at a tool control unit 312 of the tool 300. The electronic elements in the tool 300, such as the motor 308 and the electronic element 306, may be communicably coupled to the tool control unit 312, which may comprise a processor and circuitry to distribute power and communications signals. Power and communications for the motor 308 may be provided through a wire 314 coupled between the motor 308 and the tool control unit 312. The electronic element 306 of the second portion 304 may be communicably coupled to and receive power and communications from the tool control unit 312 through a wire 316, a wire 318, and a slip ring interface 320.

The slip ring interface 320 may comprise a first section coupled to the first portion 302 and communicably coupled to controller 322, a second section coupled to the second portion 304 and communicably coupled to controller 324, and a plurality of conductor paths 326(1)-(*n*) between the first and second portions, in particular between the controllers 322 and 324, where n is the number of conductor paths 326. The controllers 322 and 324 may comprise integrated controllers, for example, with processors and memory devices containing a set of instructions for the processors being located on a single chip. The controllers 322 and 324 may further comprise analog or digital circuitry. The conductor paths 326(1)-(*n*) may comprise pins, brushes, or other conductor-type connections that maintain conductivity as the second portion 304 rotates with respect to the first portion 302. Power and communication signals may be transmitted between the controllers 322 and 324 over the conductor paths 326(1)-(*n*).

Notably, the rotational movement between the portions of the slip ring interface 320 as well as downhole temperature and pressure conditions may cause noise, short circuits, or open circuits to develop across the conductor paths 326(1)-(*n*). The noise, short circuits, and open circuits may comprise error conditions that are detrimental to the integrity of the power and communications signals transmitted through the conductor paths 326(1)-(*n*). Other error conditions include misalignment of the contacts of the conductor paths 326(1)-(*n*) due to assembly errors or high shock/vibration, bent or worn contacts, and lift or separation between the contacts (especially at high speed and/or in high viscosity oil). In certain instances, the error conditions may cause a catastrophic loss of transmission through certain conductor paths 326(1)-(*n*), rendering the tool unusable and requiring that the tool 300 be removed to the surface and replaced.

According to aspects of the present disclosure, the slip ring interface 320 may utilize dedicated, redundant, and/or adaptable power and communications signal pathways through the conductor paths to reduce, correct, and/or adjust for the loss of signal transmission across one or more of the conductor paths. As will be described below, each of the conductor paths may be selectively associated with and dedicated to the transmission of a different type of signal (e.g., power or communication) by the controllers 322 and 324, with each type of signal having at least two dedicated, redundant conductor paths. If/when one of the conductor paths fails, there is at least one other conductor path through which the power or communications signal can be transmitted. In certain embodiments, in the case of a failure of all of the conductor paths dedicated to one type of signal, controllers 322 and 324 may selectively associate one of the remaining conductor paths to ensure that both power and communications signals are transmitted across the slip ring interface 320.

Separating the power and communications signals onto individual conductor paths may reduce errors in the communications signal. In certain embodiments, the electronic element 306 may comprise a variable load that causes transients in current draw and voltage. If a communications signal is superimposed on a power signal through a single conductor path, the transients may disrupt the communications signal. By separating the communications signal from the power signal, the impedance and load on the communications path may be nearly constant, reducing errors.

In addition to redundant conductor paths through the slip ring interface 320, the tool 300 may further include redundant channel 328 through which one of a power or communications signal may be transferred. The redundant coupling 328 may comprise an inductive coupling communicably coupled to tool control unit 312 to transmit a signal between the first portion 302 and the second portion. In certain embodiments, if the transmission of power or communications signals through the slip ring interface 320 is compromised, the tool control unit 312 may switch from the slip ring interface 320 to the redundant coupling 328 to transmit the power or transmission signal. Other redundant couplings are possible, including an additional slip ring interface.

Additionally, power signal transfer across the slip ring interface 320 may be improved by adding electrical capacitance on a non-power generating side of the tool 300 interface, in this case the second portion 304. In the embodiment shown, conductor path 326(1) is selectively associated with a power signal and a capacitor 330 is coupled between the conductor path 326(1) and a ground potential. The capacitor 330 may compensate for minor noise (e.g., debris, wear, misalignment) or even brief non-contact events (lift off) that might occur at the conductor path 326(1) of the slip ring interface 320, and similar capacitors may be used with the conductor paths 326(2)-(*n*). In this manner, power can be made less sensitive to common slip ring problems and exhibit an improved operating envelope. Typical actions to improve contact force/contact pressure (spring loading contacts, increased loading of contacts, and shape of contacts) increase wear on the contacts. The added capacitance addresses the contact issues without an additional force that may reduce the usable life of the contacts.

In certain embodiments, the second portion 304 may be at a ground potential (e.g., when the second portion 304 is grounded through the first portion 302 through bearings (not shown) that provide free rotation between the portions) and the capacitor 330 may be coupled between the conductor path 326(1) and the second portion 304. In other embodiments, ground potential may be provided through another of the conductor paths, and the capacitor 330 may be coupled between the conductor path 326(1) and the grounded conductor path. Other variations can occur depending on the nature of the power being transmitted across the slip ring. For example if a positive power signal and a negative power signal are being transmitted across separate conductor paths, each conductor path may have a separate capacitor or the capacitor may be located across the positive power and negative power electrical circuits. In certain embodiments, the capacitors may be positioned within the second portion such that they can be switched in or out depending on the line configuration options desired for each conductor path 326(1)-(*n*).

In certain embodiments, the capacitor 330 may be coupled between wire 318 and a ground potential. Because the capacitor 330 may interfere with communications, the power and communications signals may be effectively separated after they leave the slip ring using hardware electronics (e.g., diodes, capacitors, transformers, etc.). Accordingly, the capacitor 330 may be essentially coupled to all power communications through the slip ring and also through redundant channel 328.

Figure 4A:
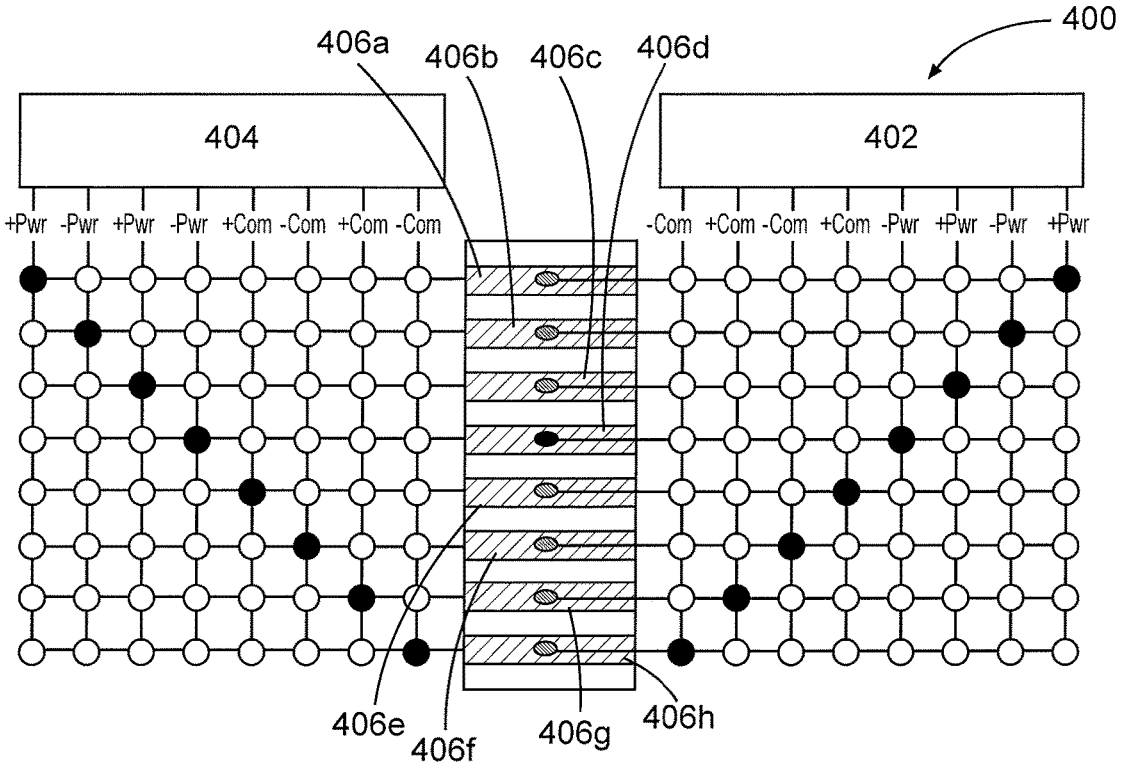
FIGS. 4A and 4B are diagrams of an example slip ring interface, according to aspects of the present disclosure.
Figure 4B:
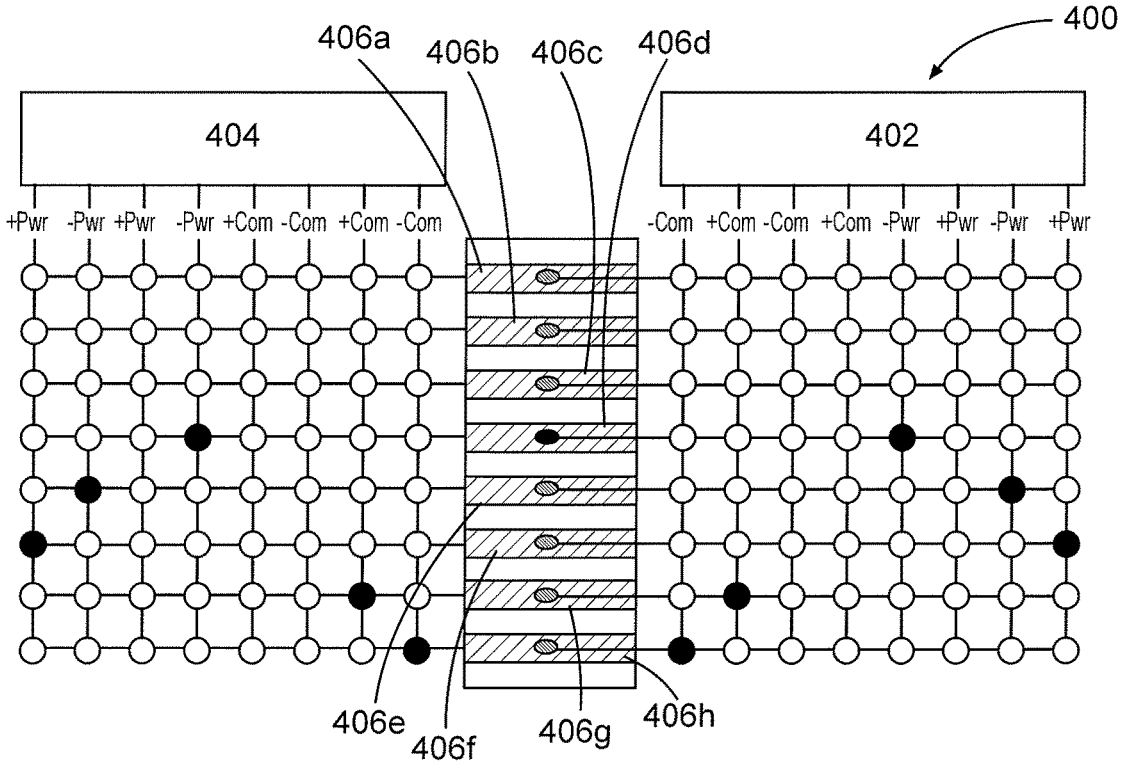

FIGS. 4A and 4B illustrate an example slip ring interface 400 that provides dedicated, redundant, and adaptable conductor paths, according to aspects of the present disclosure. The slip ring interface 400 comprises first controller 402 and second controller 404. The first controller 402 may be located in a first portion of a downhole tool, and the second controller 404 may be located in a second portion of the downhole tool that is rotationally independent of the first portion. Both the first controller 402 and the second controller 404 may comprise a processor and a memory device coupled to the processor that contains a set of instructions for the processor.

The slip ring interface 400 may further comprise conductor paths 406*a-h* through which the first controller 402 and the second controller 404 are communicably coupled. Power and/or communication signals received by one of the first controller 402 and the second controller 404 may be transmitted to the other one of the first controller 402 and the second controller 404 through the conductor paths 406*a-h*. Each of the conductor paths 406*a-h* may be associated with and dedicated to the transmission of a different type of signal, providing dedicated, bi-directional power and communications transmission between the first controller 402 and the second controller 404.

In the embodiment shown, each of the conductor paths 406*a-h* is associated with one of a power transmission and a communications transmission. The slip ring interface 400 comprises bi-directional transmissions, with the power and communications signals further divided by the direction in which the signal transmission will occur. For example, +Pwr signals and +Com signals represent power and communications signals, respectively, traveling from the first controller 402 to the second controller 404. In contrast, −Pwr signals and −Com signals represent power and communications signals, respectively, traveling from the second controller 404 to the first controller 402.

In certain embodiments, each of the conductor paths 406*a-h* may be associated with one of a power transmission and a communications transmission and one transmission direction. In FIG. 4A, for example, conductor paths 406*a* and 406*c* are selectively associated with and dedicated to +Pwr signals, conductor paths 406*b* and 406*d* are associated with and dedicated to −Pwr signals, conductor paths 406*e* and 406*g* are associated with and dedicated to +Com signals; and conductor paths 406*f* and 406*h* are associated with and dedicated to −Com signals. Other arrangements and configurations are possible. Notably, each signal type and direction has multiple, redundant conductor paths through which to travel.

In certain embodiments, the first controller 402 and second controller 404 may monitor the conductor paths 406*a-h* for error conditions. For example, the first controller 402 and second controller 404 may monitor conductor path degradation by measuring changes in current and/or voltage across each of the conductor paths 406*a-h*. The first controller 402 and second controller 404 also may monitor conductor path degradation using software-based error detection and correction statistics, such as cyclic redundancy checks (CRC), checksums, hash functions, parity, error correcting codes, automatic repeat requests (ARQ) and others. In yet other embodiments, the first controller 402 and second controller 404 may monitor conductor path degradation by sampling the analog current or voltage waveforms from the conductor paths 406*a-h* to determine if a particular conductor path is degraded, experiencing opens or shorts, or is subject to noise. The sampled waveforms could be analyzed to measure properties such as signal rise/fall times, glitches, ringing, or presence of specific frequencies or bands by analyzing the Fourier response of the data. Additionally, the first controller 402 and second controller 404 may contain circuitry to inject characteristic waveforms for the purpose of measuring and detecting changes in the physical properties of the conductor path, such as characteristic impedance.

In certain embodiments, the first controller 402 and second controller 404 may change the signal type and direction associated within a conductor path. The signal type and direction associated with a conductor path may be changed depending on usage conditions for the slip ring interface 400, or to ensure that each signal type and direction has at least one associated conductor path. Usage conditions may be characterized by the types of signals and amount of data to be transmitted across the interface during a given time period. For example, if a large amount of communications data needs to be transmitted across the slip ring interface 400 from the first controller 402 to the second controller 404, one or more of the conductor paths associated with the +Pwr, −Pwr, and −Com signals may be temporarily associated with a +Com signal to provide increased data bandwidth through the interface 400. Similarly, if the first controller 402 and second controller 404 identify error conditions on all of the conductor paths associated with a first signal type and direction, one or more of the other conductor paths may have its associated signal type and direction changed to the first signal type and direction to ensure that each signal type and direction has at least one associated conductor path.

In FIG. 4B, conductor paths 406*a-c* have suffered error conditions. In certain embodiments, the first controller 402 and second controller 404 may respond to the error conditions by disconnecting the faulty conductor paths 406*a-c*. Because conductor paths 402*a* and 402*c* were the only conductor paths associated with the +Pwr signal, the first controller 402 and second controller 404 may change the associations of conductor paths 402*e* and 402*f* to provide a conductor path for the +Pwr signal to ensure that each signal type and direction has at least one associated conductor path. In certain embodiments, the first controller 402 and second controller 404 may comprise instructions regarding the minimum number of conductor paths allowable for each signal type and direction. For example, if a large amount of communications data must be transmitted from the second controller 404 to the first controller 402, the first controller 402 and second controller 404 may maintain at least two conductor paths associated with a −Com signal. If an insufficient number of working conductor paths remain, the first controller 402 and second controller 404 may associate more than one signal type to a conductor path. The signals may be transmitted together using modulated waveforms or other techniques that would be appreciated by one of ordinary skill in the art in view of this disclosure.

The first controller 402 and second controller 404 may further control how the power and communications signals are transmitted through the conductor paths 406*a-h*. For example, when all of the conductor paths 406*a-h* are functional, the first controller 402 and second controller 404 may use all or more than one of the pathways associated with a particular signal type and direction to transmit the corresponding signal in parallel (e.g., transmitting portions of the +Pow signal simultaneously across conductor paths 402*a* and 402*c*), increasing the transmission speed across the interface. In contrast, when one of the conductor paths for a signal type and direction fails, the entire signal may be transmitted through the remaining redundant path (e.g., 402*c*).

Moreover, the first controller 402 and second controller 404 may transmit communications data through the +Com and −Com signals using one or more communications protocols to improve data throughput. The first controller 402 and second controller 404 may comprise firmware or software instructions that cause the first controller 402 and second controller 404 to process, transmit, and receive the communications data according to the protocol. An example protocol includes a controller area network (CAN) bus protocol which is a bus standard designed to allow microcontrollers and devices to communicate with each other without a host or primary controller. Another example protocol is MIL-STD-1553, which defines the mechanical, electrical, and functional characteristics of a serial data bus. Other protocols include RS-232, RS-232 Transistor Transitor Logic (TTL), IEEE 422, IEEE 485, and other protocols that would be appreciated by one of ordinary skill in the art in view of this disclosure.

In certain embodiments, the first controller 402 and second controller 404 may further comprise firmware that prioritizes the communications data to be transmitted through the conductor paths 406*a-h*. Priority may be set, for example, based on the type of communications to be sent (e.g., commands, status check, etc.). The firmware may comprise one or more queues or data stacks through which the communications may be categorized and stored until transmission. High priority or critical communication may be sent first, before less critical information. In certain embodiments, the prioritization may occur when one or more conductor paths associated with the communications signals have suffered an error condition. In such instance, the prioritization can be utilized to ensure that the interface 400 and corresponding tool still function.

Figure 5:
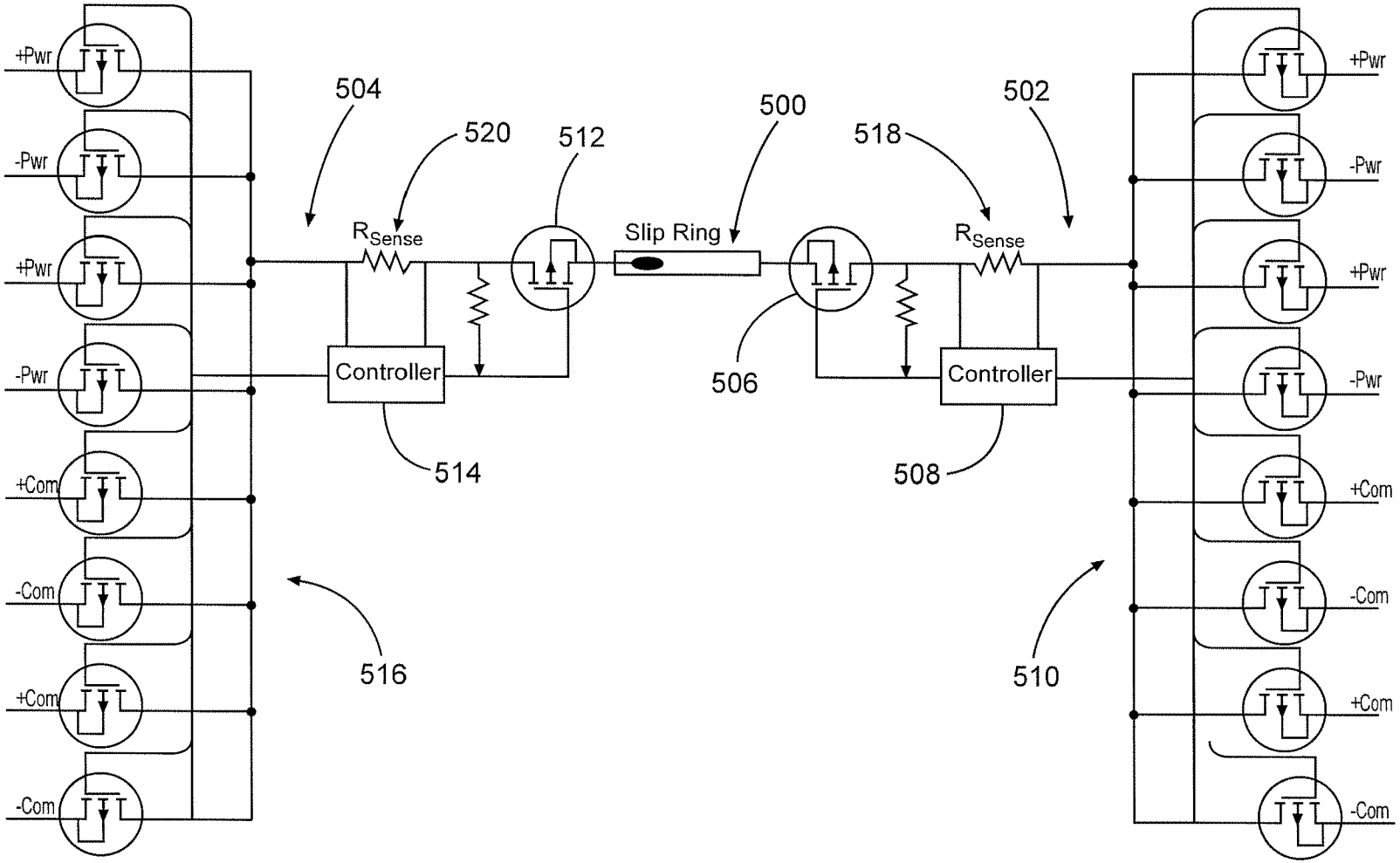
FIG. 5 is a diagram of example slip ring interface electronics, according to aspects of the present disclosure.

FIG. 5 is a diagram of example slip ring interface electronics, according to aspects of the present disclosure. In particular, FIG. 5 illustrates example electronics for one conductor path 500 of a slip ring interface comprising first electronics 502 and second electronics 504. The first electronics may comprise a first conductor path switch 506, a first controller 508, and a first plurality of signal-type switches 510, each corresponding to a different signal-type and direction. The first conductor path switch 506 may be coupled at one side to the conductor path 500 and at another side to the first plurality of signal-type switches 510. The second electronics 504 may comprise a similar configuration with a second conductor path switch 512, a second controller 514, and a second plurality of signal-type switches 516, each corresponding to a different signal-type and direction.

The first controller 508 may control the first conductor path switch 506 and the first plurality of signal-type switches 510. Similarly, the second controller 514 may control the second conductor path switch 512 and the second plurality of signal-type switches 516. In certain embodiments, the first conductor path switch 506, the first plurality of signal-type switches 510, the second conductor path switch 512, and the second plurality of signal-type switches 516 may comprise transistors, such as Field Effect Transistors (FET), and the first controller 508 and second controller 514 may force the transistors to conduct current by supplying voltages to their gates.

In certain embodiments, the first and second electronics 502 and 504 may comprise first and second sense resistors 518 and 520 coupled between the first conductor path switch 506 and the first plurality of signal-type switches 510, and between the second conductor path switch 512 and the second plurality of signal-type switches 516, respectively. First controller 508 may be connected in parallel with the first sense resistor 518, and may measure the voltage response of the resistor to determine whether the conductor path 500 is functioning, to identify an error condition associated with the conductor path 500, and or to communicate with the second controller 514, which may be similarly positioned and perform similar actions with respect to the second sense resistor 520. If an error condition associated with the conductor path 500 is identified, the first and second controllers 508 and 514 may disconnect the conductor path 500 by removing supplied voltages from the gates of the first and second switches 506 and 512, respectively.

In certain embodiments, the first controller 508 and second controller 514 may communicate across the conductor path 500 by injecting current or applying voltage variance onto the signal path. The communication may be sensed at the other sense resistor and decoded by the controller. This communication can occur over any available conductor path and can be multiplexed in with any existing signal on the path through numerous ways including time division multiplex, frequency division multiplex, bit stream insertion or any other method of sharing the channel capacity. Hence there is an overlay of a controller signal used to communicate between the two controllers on either side of the slip ring. In other embodiments, the first controller 508 and second controller 514 may communicate across a dedicated channel (not shown) that may allow for communications without interference from the power and communications signals transmitted through the conductor paths.

In certain embodiments, the first controller 508 and second controller 514 may communicate to determine which signal type and direction to associate with the conductor path 500. The first controller 508 and second controller 514 may contain algorithms to determine which signal type and direction to associate with the conductor path 500, or they may be in communication with one or more other controllers which may supply that information. Once the signal type and direction is determined, the first controller 508 and second controller 514 may supply voltages to the gates of the corresponding switches from the first and second plurality of signal-type switches 510 and 514. The other switches may not be activated, preventing those signal types and directions from being transmitted across the conductor path 500. Notably, two or more signal types and directions may be switched on at the same time, allowing the signals to be combined and conductor path to the shared. For example, power and communications signals may be multiplexed and transmitted simultaneously though a single conductor path. Additionally, the signal type and direction can be easily changed as needed through the first and second controller 508 and 514.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A slip-ring interface, comprising:

a first section;

a first controller coupled to the first section;

a second section rotationally independent from the first section;

a second controller coupled to the second section;

a first conductor path between the first section and the second section, the first conductor path selectively associated with a first signal type by the first and second controllers;

a second conductor path between the first section and the second section, the second conductor path selectively associated with a second signal type by the first and second controllers;

a third conductor path between the first section and the second section, the third conductor path selectively associated with the first signal type by the first and second controllers; and a fourth conductor path between the first section and the second section, the fourth conductor path selectively associated with the second signal type by the first and second controllers.

2. The slip-ring interface of claim 1, wherein at least one of the first and second controllers comprises a processor and a memory device containing a set of instructions that, when executed by the processor, cause the processor to:

determine a first error condition corresponding to the first conductor path;

determine a second error condition corresponding to the third conductor path; and in response to the first and second error conditions, disconnect the first conductor path and the third conductor path; and associate one of the second conductor path and the fourth conductor path with the first signal type.

3. The slip-ring interface of claim 2, wherein at least one of the first error condition and the second error condition comprises at least one of noise, a short circuit, or an open circuit in the corresponding conductor path.

4. The slip-ring interface of claim 2, wherein the set of instructions that cause the processor to determine the first error condition corresponding to the first conductor path further cause the processor to at least one of measure changes in current and/or voltage across each of the first conductor path;

sample current and/or voltage waveforms across the first conductor path; and generate or identify at least one of cyclic redundancy checks (CRC), checksums, hash functions, parity, error correcting codes, and automatic repeat requests (ARQ).

5. The slip-ring interface of claim 2, wherein the set of instructions further cause the processor to determine a third error condition corresponding to the second conductor path; and in response to the third error condition, disconnect the second conductor path; and associate the fourth conductor path with the first signal type and the second signal type.

6. The slip-ring interface of claim 1, wherein at least one of the first and second controllers comprises a processor and a memory device, the memory device containing a set of instructions that, when executed by the processor, cause the processor to:

determine a usage condition; and in response to usage condition, associate one of the second conductor path and the fourth conductor path with the first signal type.

7. The slip-ring interface of claim 1, wherein the first signal type comprises a power signal and the second signal type comprises a communications signal.

8. A method for signal transmission across an interface, comprising:

selectively associating a first conductor path with a first signal type with a first controller coupled to a first portion and a second controller coupled to a second portion rotationally independent from the first portion, the first conductor path coupling the first portion and the second portion, selectively associating a second conductor path with a second signal type with the first controller and the second controller, the second conductor path communicably coupling the first portion and the second portion;

transmitting a first signal of the first signal type across the first conductor path; and transmitting a second signal of the second signal type across the second conductor path;

selectively associating a third conductor path with the first signal type with the first controller and the second controller, the third conductor path communicably coupling the first portion and the second portion; and selectively associating a fourth conductor path with the second signal type with the first controller and the second controller, the fourth conductor path communicably coupling the first portion and the second portion.

9. The method of claim 8, further comprising determining a first error condition corresponding to the first conductor path with at least one of the first and second controllers;

determining a second error condition corresponding to the third conductor path with at least one of the first and second controllers; and in response to the first and second error conditions, disconnecting the first conductor path and the third conductor path, and selectively associating the fourth conductor path with the first signal type with the first controller and the second controller; and transmitting the first signal through the fourth conductor path.

10. The method of claim 9, wherein at least one of the first error condition and the second error condition comprises at least one of noise, a short circuit, or an open circuit in the corresponding conductor path.

11. The method of claim 9, wherein determining the first error condition corresponding to the first conductor path comprises at least one of measuring changes in current and/or voltage across the first conductor path;

sampling current and/or voltage waveforms across the first conductor path; and generating or identifying at least one of cyclic redundancy checks (CRC), checksums, hash functions, parity, error correcting codes, and automatic repeat requests (ARQ).

12. The method of claim 9, further comprising determining a third error condition corresponding to the second conductor path; and in response to the third error condition, disconnecting the second conductor path, and selectively associating the fourth conductor path with the first signal type and the second signal type with the first controller and the second controller; and transmitting the first signal and second signal through the fourth conductor path.

13. The method of claim 8, further comprising prioritizing data to be transmitted across at least one of the first, second, third, or fourth conductor paths.

14. The method of claim 8, wherein transmitting the first signal and/or the second signal comprising transmitting according to at least one communications protocol comprising at least one of a controller area network (CAN) bus protocol and a MIL-STD-1553 protocol.

15. A downhole tool, comprising:

a first portion;

a second portion rotationally independent from the first portion;

first electronics coupled to the second portion;

a control unit coupled to the first portion and communicably coupled to a power source and a communications channel;

a slip-ring positioned at an interface between the first portion and the second portion and communicably coupled to the first electronics and the control unit, the slip-ring comprising a first section coupled to the first portion;

a first controller communicably coupled to the first section and the control unit;

a second section coupled to the second portion;

a second controller communicably coupled to the second section, the first controller, and the first electronics;

a first conductor path and a second conductor path between the first section and the second section, the first and second conductor paths selectively associated with a power signal type by the first and second controllers; and a third conductor path and a fourth conductor path between the first section and the second section, the third and fourth conductor paths selectively associated with a communications signal type by the first and second controller; and a power path positioned at the interface between the first portion and the second portion and communicably coupled to the first electronics and the control unit.

16. The downhole tool of claim 15, further comprising a capacitor coupled between at least one of the first conductor path, the second conductor path, and the power path and a ground potential.

17. The downhole tool of claim 15, wherein the first controller and the second controller contain sets of instructions that cause the first controller and the second controller to cooperatively:

determine a first error condition corresponding to the first conductor path;

determine a second error condition corresponding to the second conductor path;

in response to the first and second error conditions, disconnect the first conductor path and the second conductor path; and selectively associate one of the third conductor path and the fourth conductor path with the power signal type.

18. The downhole tool of claim 15, wherein the control unit comprises a processor and a memory device containing a set of instruction that, when executed by the processor cause the processor to disconnect a power signal from the slip-ring; and connect the power signal to the power path, wherein the power path comprises an inductive coupling.

* * * * *